US007959005B2

(12) United States Patent
Berg et al.

(10) Patent No.: US 7,959,005 B2
(45) Date of Patent: Jun. 14, 2011

(54) BLISTER ARRANGEMENT AND CARDBOARD BLANK THEREFOR

(75) Inventors: Nancy Berg, Hamburg (DE); Uwe Stroinski, Waiblingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/593,551

(22) PCT Filed: Feb. 22, 2008

(86) PCT No.: PCT/EP2008/052206

§ 371 (c)(1),
(2), (4) Date: Feb. 4, 2010

(87) PCT Pub. No.: WO2008/119602

PCT Pub. Date: Oct. 9, 2008

(65) Prior Publication Data

US 2010/0140132 A1 Jun. 10, 2010

(30) Foreign Application Priority Data

Mar. 29, 2007 (DE) ..... 10 2007 015 090

(51) Int. Cl.
*B65D 83/04* (2006.01)

(52) U.S. Cl. ..... 206/531; 206/539

(58) Field of Classification Search ..... 206/528, 206/530, 531, 534, 534.1, 534.2, 538, 539, 206/462, 463; 229/121, 122, 222, 230, 125.125
See application file for complete search history.

(56) References Cited

U.S. PATENT DOCUMENTS

| | | | | | |
|---|---|---|---|---|---|
| 3,182,789 | A * | 5/1965 | Sparks | 206/536 |
| 3,921,804 | A * | 11/1975 | Tester | 206/531 |
| 4,125,190 | A * | 11/1978 | Davie et al. | 206/532 |
| 4,186,835 | A * | 2/1980 | Hofer | 206/539 |
| 4,998,623 | A * | 3/1991 | Doull | 206/531 |
| 5,251,757 | A * | 10/1993 | Relyea et al. | 206/531 |
| 6,047,829 | A * | 4/2000 | Johnstone et al. | 206/531 |
| 2004/0256277 | A1 * | 12/2004 | Gedanke | 206/538 |
| 2006/0138158 | A1 | 6/2006 | Drought et al. | |
| 2007/0261984 | A1 | 11/2007 | Gelardi | |
| 2007/0272586 | A1 | 11/2007 | Hession | |
| 2010/0096292 | A1 * | 4/2010 | Jones | 206/531 |

FOREIGN PATENT DOCUMENTS

| | | | |
|---|---|---|---|
| DE | 6933649 | U | 4/1970 |
| DE | 2930417 | A1 | 2/1981 |
| DE | 19916707 | A1 | 10/2000 |
| EP | 1667921 | B1 | 3/2007 |
| GB | 2256853 | A | 12/1993 |
| WO | 2004037657 | A2 | 5/2004 |
| WO | 2005049448 | A1 | 6/2005 |
| WO | 2005068304 | A2 | 7/2005 |

* cited by examiner

*Primary Examiner* — Luan K Bui
(74) *Attorney, Agent, or Firm* — Ronald E. Greigg

(57) ABSTRACT

The invention relates to a blister arrangement which includes a blister strip having a plurality of cups. The blister strip has a base region and a cover film and wherein a tablet or the like is disposed inside each cup. A blister pocket accommodates the blister strip. The blister pocket has a substantially rectangular shape with a front side, a rear side, a first lateral region, a second lateral region, and at least one open face. The front side has a first recess that is the same size as or slightly larger than the size of a cup, and the rear side has a second recess opposite the first recess. The cup is oriented in the direction of the second recess, and the cover film of the blister strip is oriented toward the first recess. The blister strip may be pulled out through the open face.

19 Claims, 4 Drawing Sheets

BLISTER ARRANGEMENT AND CARDBOARD BLANK THEREFOR

CROSS-REFERENCE TO RELATED APPLICATION

This application is a 35 USC 371 application of PCT/EP2008/052206 filed on Feb. 22, 2008.

BACKGROUND OF THE INVENTION

1. Field of the Invention

The present invention relates to a blister arrangement and to a cardboard blank for a blister pocket that is part of a blister arrangement.

2. Description of the Prior Art

Blisters are used especially for medications; one or more blisters are disposed loosely in a folding box, typically made from some kind of cardboard. The blisters are known to include a base region, with a plurality of cups for receiving a tablet or the like, and a cover film or foil, which covers the cups that are open toward one side. The cover film or foil is typically an aluminum foil, and the base region is made from a plastic material. The tablets disposed in the cups may be forced out through the cover film or foil by pressure against an underside of the blister. Particularly with medications, there are often prescribed rules for the correct order in which such medications are to be taken. It is known for blisters to be marked, for instance by suitable imprinting, with rows of numbers or days of the week. It is easy for a patient to make a mistake, such as taking a tablet from the wrong cup. Pharmaceutical applications are also known in which the particular proportions of active ingredient must be varied with progressive use. In that case, the predetermined order in which the tablets are taken must be assured exactly, to avoid incorrect doses of the medication. The imprints made on the blisters, however, are helpful only if a patient complies exactly with the order.

ADVANTAGES AND SUMMARY OF THE INVENTION

The blister arrangement according to the invention has the advantage over the prior art that it is possible to ensure the tablets or the like are removed from a blister in order. Thus the blister arrangement of the invention has the function of helping with the dosage of medications for instance with different active ingredient intensities, or when different types of medications are to be taken in a certain order. This is attained according to the invention in that the blister arrangement has a blister strip with a plurality of cups and a blister pocket in which the blister strip is disposed. The cups each serve to receive one tablet or capsule or the like. The blister pocket is embodied essentially rectangularly, with a front side, and a rear side, and at least one open face end. The front side comprises a first lateral portion and a second lateral portion which are attached to opposite edges of the rear side by two fold seams. The blister strip can be pulled out of the blister pocket through the open face end. In the front side of the blister pocket, a first recess is disposed that is the same size or slightly larger than a size of a cup. A second recess, diametrically opposite the first recess, is disposed in the rear side. The blister strip is disposed such that a cover film or foil is oriented in the direction of the first recess. As a result, it is possible for one tablet to be forced out through the first recess in the front side and removed by pressing against the cup at the second recess in the rear side. Since the cup is flat after the tablet is forced out, it is possible to pull the blister strip out of the blister pocket as far as the next still-full cup. Since for removing the tablets the blister strip must be pushed forward by one blister cup at a time inside the blister pocket, it can be ensured in a simple way that a predetermined order of removing the tablets from the blister strip is adhered to.

Preferably, the blister pocket further includes a third recess in the front side and a fourth recess in the rear side. As a result, it is possible for a blister strip to be used in which two rows of cups are disposed parallel next to one another.

Especially preferably, the first recess and the third recess are disposed next to one another in the front side of the blister pocket. This makes simple removal of the tablets or the like from the blister strip possible.

In a further preferred embodiment of the invention, the blister pocket further includes a guide element, which is disposed between the second and fourth recesses in the rear side of the blister pocket. This ensures that the blister strip can be guided while a tablet is being pushed out. The guidance of the blister strip is effected in particular by means of the still-filled cups on the blister strip that protrude outward.

Also preferably, the blister pocket further includes a stop, for preventing the blister strip from being pulled out too far unintentionally. As the blister strip is pulled out, the cups that are still filled with tablets strike the stop. Especially preferably, the stop is a peripheral region of the second recess, so that the stop at the same time ensures that a still-full blister strip, from which one tablet is now to be removed in the predetermined order, is disposed at one position of the first recess, so that the tablet can then simply be removed from that cup.

Preferably, the blister strip has a tab on an end oriented toward the open face end of the blister pocket. This makes it possible to pull the blister strip out of the blister pocket more easily.

Also preferably, the first recess and the third recess are each embodied identically, and/or the second and fourth recesses are each embodied identically.

To enable simple, inexpensive production of the blister pocket, the blister pocket is preferably made from paper or paperboard or cardboard or a similar material.

To furnish an especially simple construction of the blister arrangement, the cups of the blister strip are preferably disposed parallel to one another in a first and a second row. Especially preferably, the cups of the first row are offset longitudinally from the cup of the second row. As a result, even when two parallel rows of cups are used, it can be ensured that only one cup to be emptied at a time is disposed at a recess.

Preferably, the first and second lateral regions of the blister pocket are each embodied as small edge regions, which are furnished by folding over the front side relative to the rear side. As a result, the blister pocket can be produced especially simply, and moreover, a certain friction can be ensured between the blister pocket and the blister strip because of the narrow lateral portions, so that the blister strip is prevented from slipping out of the blister pocket unintentionally.

Also preferably, the blister arrangement further includes a package for receiving the blister pocket, in which the blister strip is disposed. As a result, additional protection for the blister pocket can also be furnished. The package and the blister pocket are preferably made from the same material, in particular a cardboard, paper, or paperboard.

The present invention further relates to a cardboard blank for a blister pocket. The cardboard blank includes a front side, having at least one first recess; a rear side, having at least one second recess; and at least one fold seam, which separates the front side from the rear side. After the material is folded over at the fold seam, the front side also rests on the rear side, and the fold seam forms the first lateral region of the front side. After the folding over, the free long sides, facing one another, of the front side and rear side are then joined together, for instance by means of adhesive bonding. The two opposed face ends of the blister pocket may stay in a non-joined state, so that a blister strip can simply be introduced into the blister pocket from both sides.

The cardboard blank according to the present invention further preferably includes a third recess and a fourth recess as well; the rear side then includes the second recess and the fourth recess, and the front side is subdivided into a first portion and a second portion, and the first recess is disposed in the first portion and the third recess in the second portion. The rear side is disposed between the first portion and the second portion, and between the first portion and the rear side region, a first fold seam is provided, and between the second portion and the rear side region, a second fold seam is provided. Thus the cardboard blank is shaped into the blister pocket by folding the first portion at the first fold seam and folding the second portion at the second fold seam. The two free long ends of the first and second portions are joined, for instance by means of adhesive bonding or the like, after the folding over is done.

The blister arrangement of the invention is used in particular for packaging medications in the form of tablets. According to the invention, the term "tablets" is understood to mean any possible form of a medication in solid or powdered form, such as capsules, oblongs, etc.

BRIEF DESCRIPTION OF THE DRAWINGS

Below, preferred exemplary embodiments of the invention are described in detail in conjunction with the drawings. In the drawings.

DESCRIPTION OF THE PREFERRED EMBODIMENTS

Below, in conjunction with FIGS. 1 through 7, a blister arrangement 1 in a first preferred exemplary embodiment and an associated cardboard blank for a blister pocket will be described in detail.

Figure 1:
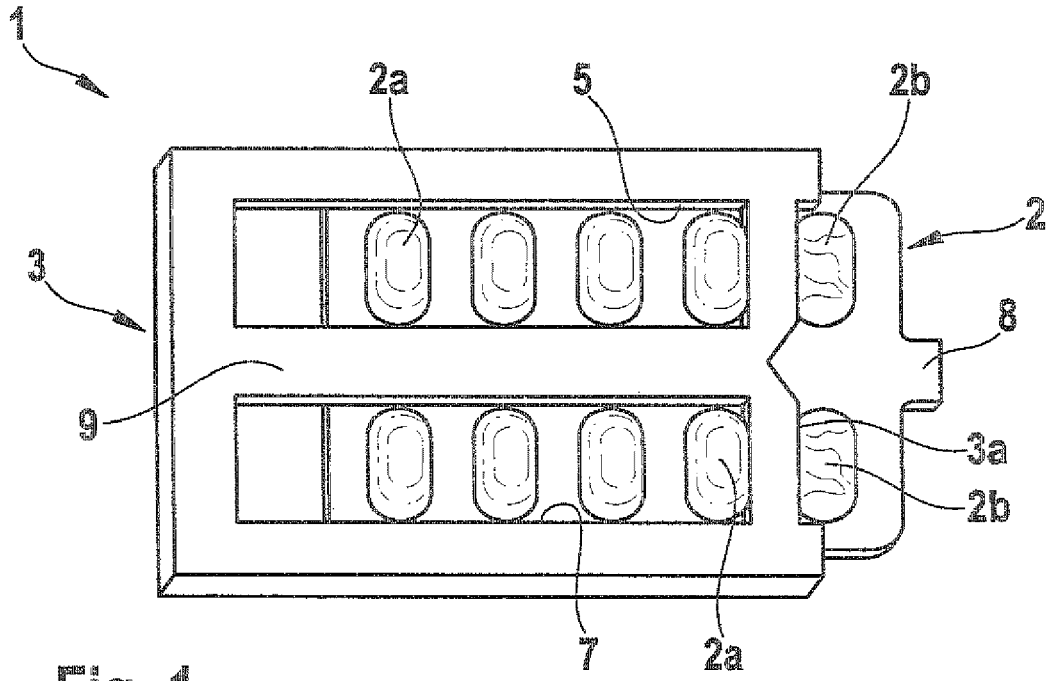
FIG. 1 is a schematic, perspective view of a rear side of a blister arrangement, in a first exemplary embodiment of the invention.
Figure 2:
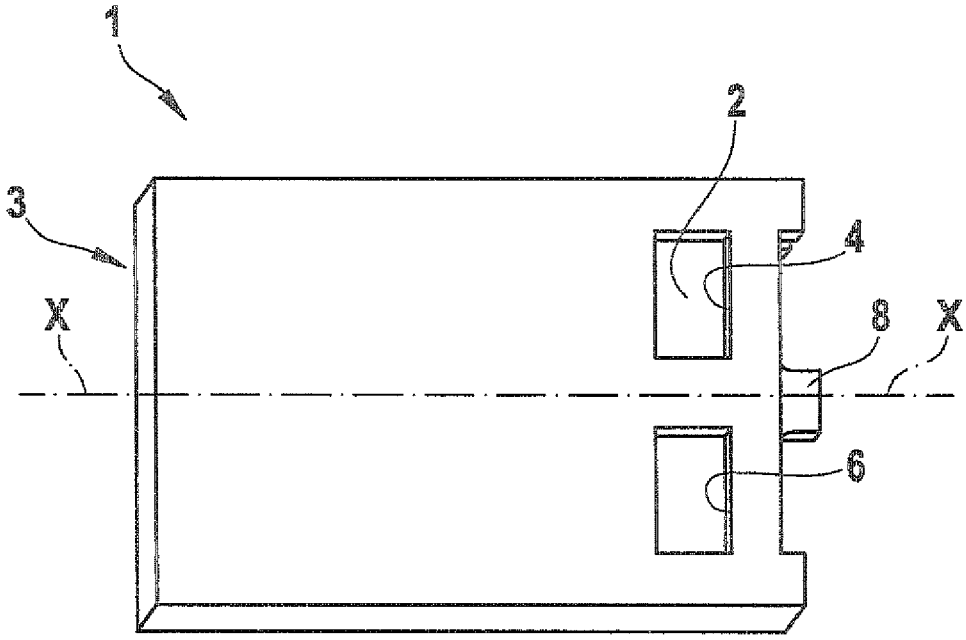
FIG. 2 is a perspective view of a front side of the blister arrangement shown in FIG. 1.

The blister arrangement 1 includes a blister strip 2, which in a known manner includes a base region having a plurality of cups 2*a* and a protective film or foil, for instance of aluminum, disposed on the open side of the cups. As can be seen from FIG. 1, two parallel rows of cups 2*a* are provided. The blister arrangement 1 further includes a blister pocket 3, in which the blister strip 2 is received. FIG. 1 shows a view of the rear side of the blister pocket 3, and FIG. 2 shows a view of the front side of the blister pocket 3. As can be seen from FIG. 2, a first recess 4 and a third recess 6 are formed in the front side. A second recess 5 and a fourth recess 7 are formed in the rear side. The first recess 4 and the third recess 6 are embodied identically, and the second recess 5 and the fourth recess 7 are embodied identically. The second and fourth recesses 5, 7 are embodied as elongated rectangles, which between them have a web 9. As can be seen particularly from FIG. 1, the web 9 acts as a guide element, since it is disposed between the two rows of cups of the blister strip. The web 9 thus ensures that the blister strip can be pulled out of the blister pocket 3 in a straight line. Reference numeral 8 indicates a tab by means of which the blister strip 2 can be pulled out.

FIG. 1 shows a state in which the blister strip has been pulled out of the blister pocket 3 by one row of cups. As can be seen from FIG. 1, the blister pocket 3, on one of its face ends, has an opening 3*a*, through which the blister strip 2 can be pulled out of the blister pocket 3.

Figure 3:
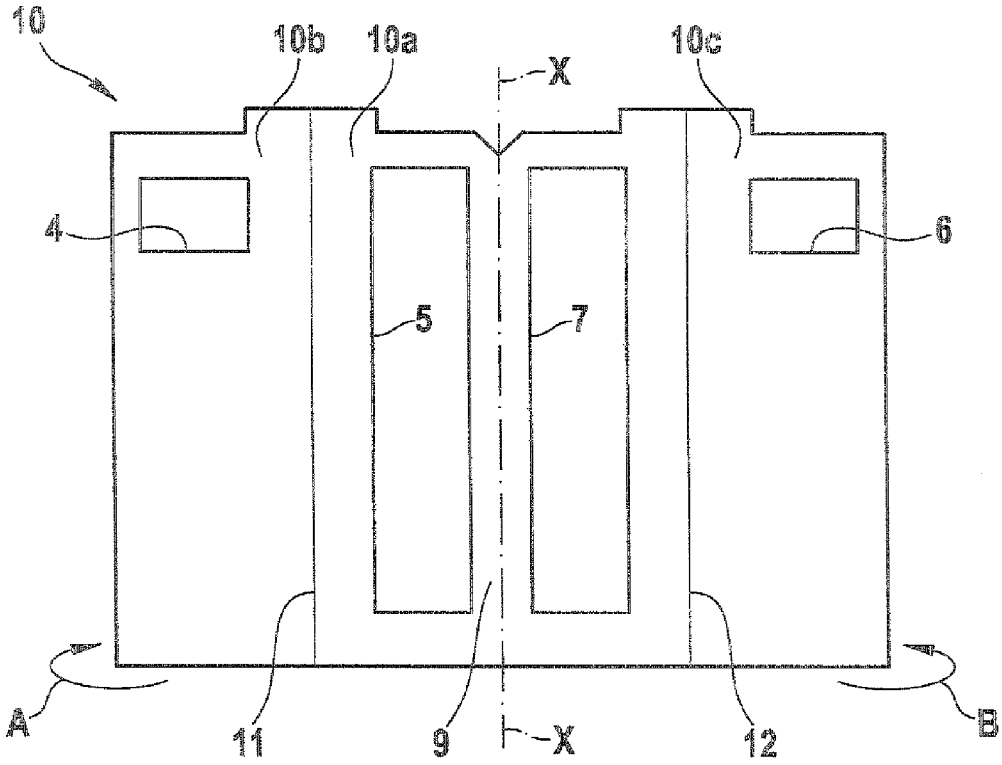
FIG. 3 is a top view on a cardboard blank, from which a blister pocket for a blister arrangement in accordance with the first exemplary embodiment can be produced.

FIG. 3 shows a cardboard blank 10 from which the blister pocket 3 can be made. The cardboard blank 10 is essentially rectangular and has a total of four stamped openings, which in the blister pocket 3 later form the first recess 4, the second recess 5, the third recess 6, and the fourth recess 7. Reference numeral 10*a* indicates a rear side. Reference numeral 10*b* indicates a first lateral portion and reference numeral 10*c* indicates a second lateral portion of a front side. The first lateral portion 10*b* is disposed on a first edge of the rear side 10*a* and extends parallel to the longitudinal direction X-X, and the second lateral portion 10*c* is disposed on the opposite edge of the rear side 10*a*. Between the first lateral portion 10*b* and the rear side 10*a*, there is a first fold seam 11, and between the second lateral portion 10*c* and the rear side 10*a*, there is a second fold seam 12. As indicated by the arrows A and B, the cardboard blank is folded in such a way that the first lateral portion 10*b* is folded over along the first fold seam 11 in the direction of the rear side 10*a*, and the second lateral portion 10*c* is folded over along the second fold seam 12, likewise in the direction of the rear side 10*a*. Next, the free long ends of the first and second portions 10*b*, 10*c* are joined together. This can be done for instance by adhesive bonding, and the first and second lateral portions 10*b*, 10*c* can partly overlap in the folded-over state. However, still other options are possible for joining the two portions 10*b*, 10*c*. A cardboard blank folded over in this way then forms the blister pocket 3, and the two face ends of the blister pocket 3 are still open. If desired, one of the two open face ends can also be optionally closed, so that a blister strip 2 introduced into the blister pocket 3 can be pulled out of the blister pocket 3 in only one direction.

After the two portions 10*b*, 10*c* have been folded over onto the rear side 10*a* of the cardboard blank 10, the two fold seams 11 and 12 form first and second edge portions of the blister pocket 3. Each edge portion has the thickness of only its respective fold seam; that is, each has a width approximately equivalent to twice the thickness of the cardboard from which the cardboard blank 10 is made.

Figure 7:
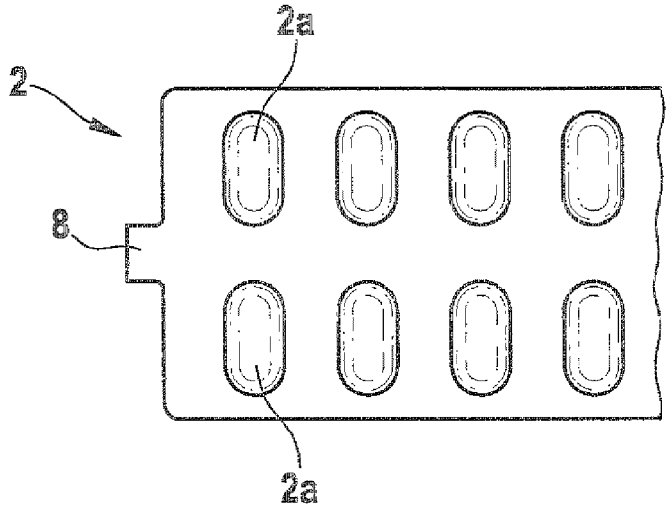
FIG. 7 is a top view on a blister strip in the first exemplary embodiment.

The blister strip 2 with the two parallel rows of cups is shown again in detail in FIG. 7. The individual cups in the two rows of cups are each disposed at the same distance from the end of the blister strip having the tab and in the longitudinal direction of the blister pocket.

As can be seen from FIG. 2, the first recess 4 and the third recess 6 on the front side of the blister pocket 3 are likewise disposed at the same distance from the end of the blister strip having the tab and in the longitudinal direction of the blister pocket. As a result, it is possible to force one tablet or the like out of one cup in each of the two rows at a time. Hence the blister arrangement is especially suitable if the patient is supposed to take two tablets simultaneously.

Figure 4:
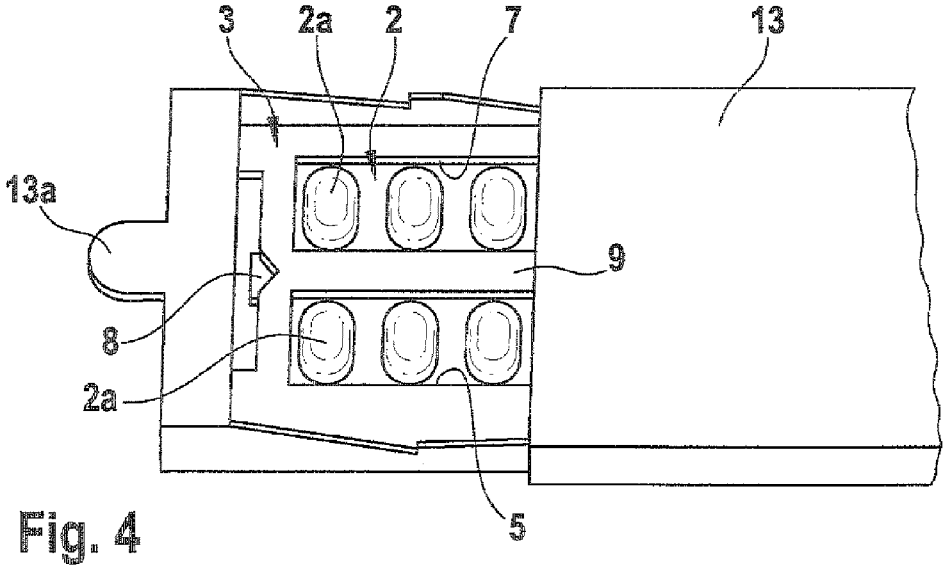
FIG. 4 is a perspective view of the blister arrangement of the first exemplary embodiment in a package, the package being partly open.
Figure 5:
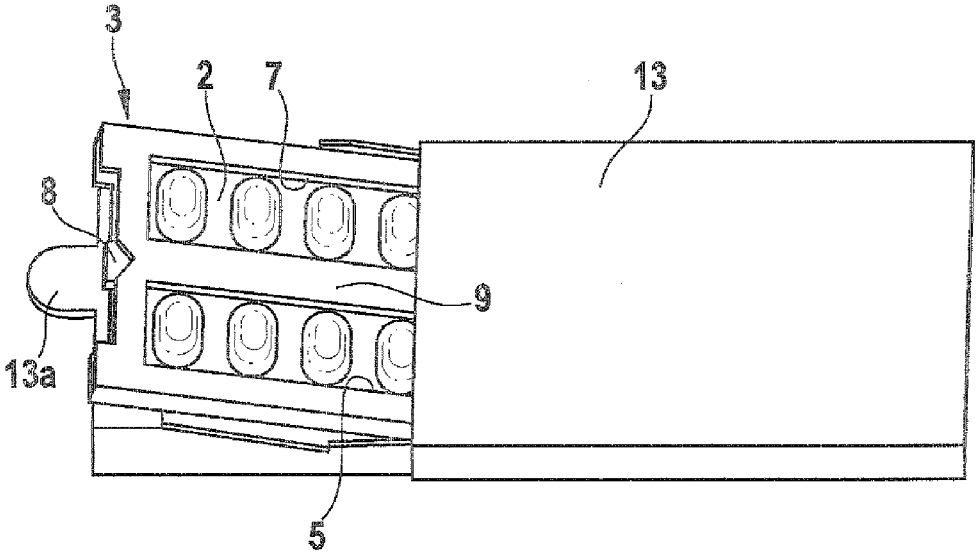
FIG. 5 is a perspective view similar to FIG. 4, in which the blister pocket has been partly removed from the package.
Figure 6:
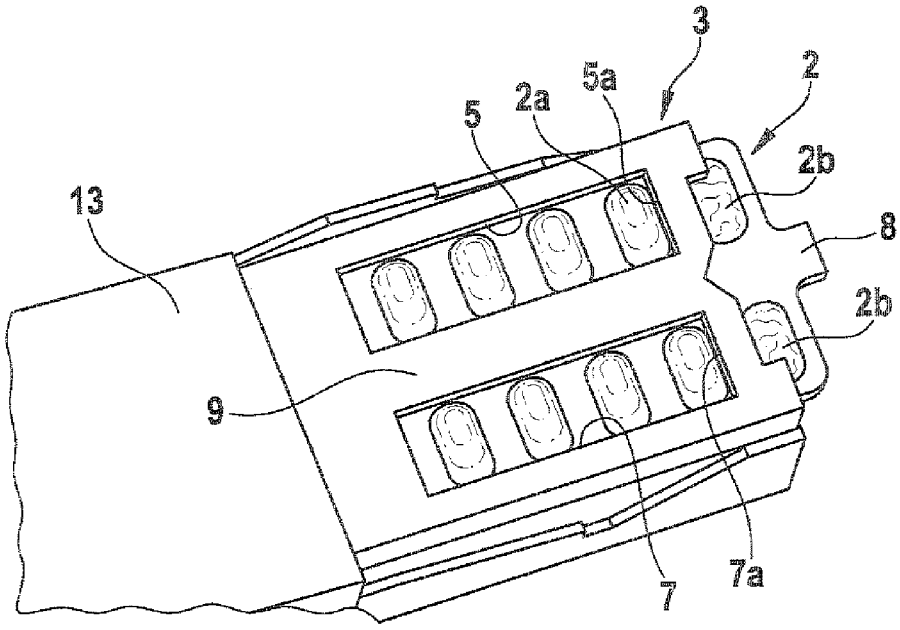
FIG. 6 is a perspective view of the blister arrangement of FIGS. 4 and 5, in which two tablets have been removed from the blister strip.

FIGS. 4 through 6 furthermore show a package 13, in which the blister pocket 3 is disposed. The package 13 is constructed similarly to a drawer and has a tab 13*a* for pulling out a drawerlike part of the package 13, in which the blister pocket 3 is disposed along with the blister strip 2. In FIG. 5, the blister pocket 3 has been lifted somewhat out of the drawerlike part, to make it possible to force tablets out of the blister strip 2. FIG. 6 shows a state in which the two tablets each disposed in the first cups of the two rows of cups have been forced out. The cups from which tablets have been forced out are identified by reference numeral 2*b*. As shown particularly clearly in FIG. 6, the peripheral region 5*a* of the second recess 5 and the peripheral region 7*a* of the fourth recess 7, these peripheral regions being located in the direction in which the blister strip is pulled out, serve as a stop, against which the still-filled cups 2*a* of the blister strip 2 strike. In this position, in which the cups 2*a* from which tablets have not yet been forced out touch the stop regions 5*a* and 7*a*, the cups are located precisely below the first recess 4 and the third recess 6, so that the tablets that are located in these cups can be forced out directly through the first recess 4 and the third recess 6.

A further function of the second recess 5 and the fourth recess 7 on the rear side of the blister pocket 3 is that the product is visible, so that it is possible to estimate how many tablets are still located in the blister strip 3.

By removing the tablet from the cup from which a tablet has been forced out, the blister strip 2 is now maximally flat at this point. If the tablet located next to it has been forced out of the cup 2*a* as well, then the blister strip 2 can be pulled out farther, as far as the next filled cups; then the still-filled cups of the second row of cups strike the respective stops 5*a* and 7*a* and thus place the blister strip 3 correctly, so as to make it possible to force the next tablets out.

Figure 8:
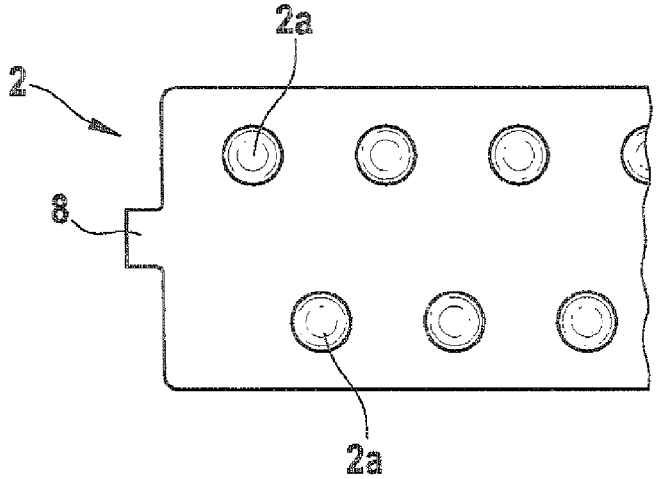
FIG. 8 is a top view on a blister strip in a second exemplary embodiment of the invention.

FIG. 8 shows a blister strip 2 in a second exemplary embodiment of the invention. In a distinction from the blister strip of the first exemplary embodiment, the first row of cups and the second row of cups are disposed in such a way that they can easily be positioned offset from one another. As a result, a separation can be done in the correct order, because only one filled cup at a time is located at the first or third recess of the blister pocket. The blister pocket 3 is equivalent to the blister pocket in the first exemplary embodiment. Otherwise, this exemplary embodiment is equivalent to the preceding exemplary embodiment, so that the description of that exemplary embodiment can be referred to.

Figure 9:
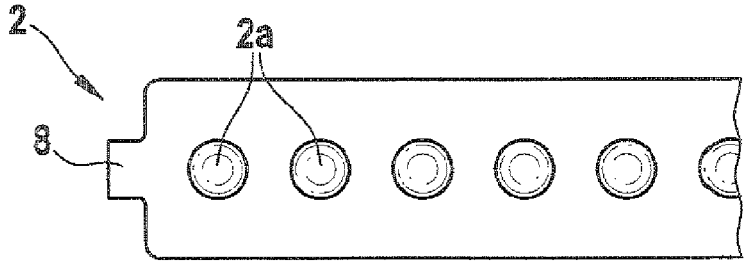
FIG. 9 is a top view on a blister strip in a third exemplary embodiment of the invention.

FIG. 9 shows a blister strip 2 in a third exemplary embodiment of the invention. In a distinction from the preceding exemplary embodiments, the blister strip 2 of the third exemplary embodiment has only one row of cups. A blister pocket, not shown, is also embodied accordingly; it has only a first recess on a front side of the blister pocket and a second recess on a rear side of the blister pocket, and the second recess is embodied in elongated form, like the second recess 5 of the first exemplary embodiment. Guidance of the blister strip is effected along the two long edges of the recess. This blister arrangement, too, can make it possible to separate the tablets of the blister strip 3. Otherwise, this exemplary embodiment is equivalent to the preceding exemplary embodiments, so that the description given of them can be referred to.

The foregoing relates to the preferred exemplary embodiments of the invention, it being understood that other variants and embodiments thereof are possible within the spirit and scope of the invention, the latter being defined by the appended claims.

The invention claimed is:

1. A blister arrangement, comprising:

a blister strip having a plurality of cups, wherein the blister strip has a base region and a cover film or foil;

one item being disposed in each of the cups; and a blister pocket, which receives the blister strip, the blister pocket having a front side, a rear side, a longitudinal direction, and at least one open face end, the front side having a first recess, which is the same size or slightly larger than a size of a cup and the rear side having a second recess, opposite the first recess, the cups being oriented in the direction of the second recess, wherein the cover film or foil of the blister strip is oriented toward the first recess, and the blister strip can be pulled out through the open face end in the longitudinal direction, wherein said second recess has a peripheral region which serves as a stop and prevents a filled cup from being pulled out through the open face end but which allows an empty cup to pass, and wherein an item can be removed from a cup when a filled cup is aligned with the first recess.

2. The blister arrangement as defined by claim 1, wherein the blister pocket furthermore includes a third recess, which is the same size or slightly larger than a size of a cup, and a fourth recess, and wherein the third recess is disposed in the front side of the blister pocket and the fourth recess is disposed in the rear side of the blister pocket, wherein the third and fourth recesses are opposite one another and an item can be removed from a cup when a filled cup is aligned with the third recess.

3. The blister arrangement as defined by claim 2, wherein the first recess and the third recess are disposed next to one another.

4. The blister arrangement as defined by claim 2, further comprising a guide element, which is disposed between the second recess and the fourth recess.

5. The blister arrangement as defined by claim 3, further comprising a guide element, which is disposed between the second recess and the fourth recess.

6. The blister arrangement as defined by claim 1, wherein the blister strip, on an end oriented toward the open face end of the blister strip, has a tab.

7. The blister arrangement as defined by claim 2, wherein the first recess and the third recess are each embodied identically, and/or the second recess and the fourth recess are each embodied identically.

8. The blister arrangement as defined by claim 3, wherein the first recess and the third recess are each embodied identically, and/or the second recess and the fourth recess are each embodied identically.

9. The blister arrangement as defined by claim 4, wherein the first recess and the third recess are each embodied identically, and/or the second recess and the fourth recess are each embodied identically.

10. The blister arrangement as defined by claim 1, wherein the blister pocket is made from paper or paperboard or cardboard and has a front side and a rear side, said front side including a first lateral portion and a second lateral portion, and wherein the first lateral portion is foldable attached to the rear side along a first fold seam and the second lateral portion is foldably attached to the front side along a second fold seam and are joined together to form the front side.

11. The blister arrangement as defined by claim 2, wherein the cups of the blister strip are disposed in first and second rows which are parallel to one another, the cups of the first row are offset longitudinally from the cups of the second row, and the first and third recesses are not longitudinally offset from each other such that only one of them can have a cup aligned with it at a time.

12. The blister arrangement as defined by claim 5, wherein the cups of the blister strip are disposed in a first and second row parallel to one another, and the cups of the first row are offset longitudinally from the cups of the second row, and the first and third recesses are not longitudinally offset from each other such that only one of them can have a cup aligned with it at a time.

13. The blister arrangement as defined by claim 1, further comprising a package for receiving the blister pocket and the blister strips disposed in it.

14. The blister arrangement as defined by claim 4, wherein the cups are arranged in two longitudinal rows which are on opposite sides of the guide element.

15. The blister arrangement as defined by claim 1, wherein the cups are arranged in one longitudinal row and the first recess is the only recess on the front side of the blister pocket.

16. The blister arrangement as defined by claim 2, wherein the cups of the blister strip are disposed in first and second parallel longitudinal rows and the cups of the first row are aligned longitudinally with the cups of the second row, and the first and third recesses are longitudinally aligned with each other such that both recesses can have cups aligned with them at the same time.

17. The blister arrangement as defined by claim 11, wherein the first and third recesses are the only recesses on the front side of the blister pocket.

18. The blister arrangement as defined by claim 12, wherein the first and third recesses are the only recesses on the front side of the blister pocket.

19. The blister arrangement as defined by claim 16, wherein the first and third recesses are the only recesses on the front side of the blister pocket.

* * * * *

UNITED STATES PATENT AND TRADEMARK OFFICE

CERTIFICATE OF CORRECTION

PATENT NO. : 7,959,005 B2
APPLICATION NO. : 12/593551
DATED : June 14, 2011
INVENTOR(S) : Nancy Berg et al.

It is certified that error appears in the above-identified patent and that said Letters Patent is hereby corrected as shown below:

Column 7, Line 1: Correct “foldable” to “foldably”.

Signed and Sealed this
Sixteenth Day of August, 2011

David J. Kappos

David J. Kappos
*Director of the United States Patent and Trademark Office*